United States Patent [19]

Sosler et al.

[11] Patent Number: 4,768,703

[45] Date of Patent: Sep. 6, 1988

[54] BARRIER CARTON WITH RECLOSABLE POUR SPOUT

[75] Inventors: James L. Sosler, Florida; Thomas P. Hambleton, Thompson Ridge, both of N.Y.

[73] Assignee: International Paper Company, Purchase, N.Y.

[21] Appl. No.: 936,207

[22] Filed: Dec. 1, 1986

[51] Int. Cl.[4] ..... B65D 43/16; B65D 5/54

[52] U.S. Cl. ..... 229/123.1; 229/123.2; 229/123.3; 229/125.05; 229/125.11; 229/125.19; 229/125.34

[58] Field of Search ..... 229/7 R, 17 R, 43, 125, 229/131, 123.1, 123.2, 123.3, 125.05, 125.11, 125.19, 125.34; 206/621, 624–626, 629, 631

[56] References Cited

U.S. PATENT DOCUMENTS

| | | | |
|---|---|---|---|
| 598,581 | 2/1898 | Spencer . | |
| 1,415,543 | 5/1922 | Gannon . | |
| 1,582,375 | 1/1926 | Bliss . | |
| 1,895,070 | 1/1933 | Czerweny | 229/131 |
| 2,053,217 | 9/1936 | Foerstner et al. | 229/17 |
| 2,072,753 | 3/1937 | Ikeda et al. | 229/125 |
| 2,617,581 | 11/1952 | Smith | 229/39 |
| 2,795,364 | 6/1957 | Benzon-Peterson | 229/37 |
| 2,847,151 | 8/1958 | Meyer-Jagenberg | 229/43 |
| 2,886,231 | 5/1959 | Benzon-Peterson | 229/14 |
| 3,029,997 | 4/1962 | Kauffeld | 229/37 |
| 3,191,848 | 6/1965 | Meyers | 206/624 |
| 3,567,106 | 3/1971 | Anderson | 229/131 |
| 3,606,133 | 9/1971 | Meyers | 229/7 R |
| 3,616,987 | 11/1971 | Krzyzanouski | 227/7 R |
| 4,209,126 | 6/1980 | Elias | 229/43 |
| 4,314,643 | 2/1982 | Forbes, Jr. | 206/621 |
| 4,397,415 | 8/1983 | Lisiecki | 229/17 R |
| 4,421,236 | 12/1983 | Lowe | 206/621 |
| 4,583,679 | 4/1986 | Johnson | 229/7 R |

*Primary Examiner*—Stephen Marcus
*Assistant Examiner*—Gary E. Elkins
*Attorney, Agent, or Firm*—Walt Thomas Zielinski

[57] ABSTRACT

An open ended carton including a membrane liner and a cover having a peripherally depending flange which overlies a top end portion of the carton. A transverse score line in the cover and contiguous perforation lines in the flange divide the cover into first and second sections to provide a hinged pour spout. An extension panel attached to a peripheral edge of the carton includes a terminal section which is heat sealed to an interior section of the peripheral cover flange. Severance of a hinged section of the extension panel defines an indentation between a top panel in the cover and the terminal section which receives the hinged section for locking reclosure of the cover. The cover is locked in open position by inward flexing of sections of the peripheral cover flange which are received in the carton opening.

12 Claims, 7 Drawing Sheets

FIG. 1
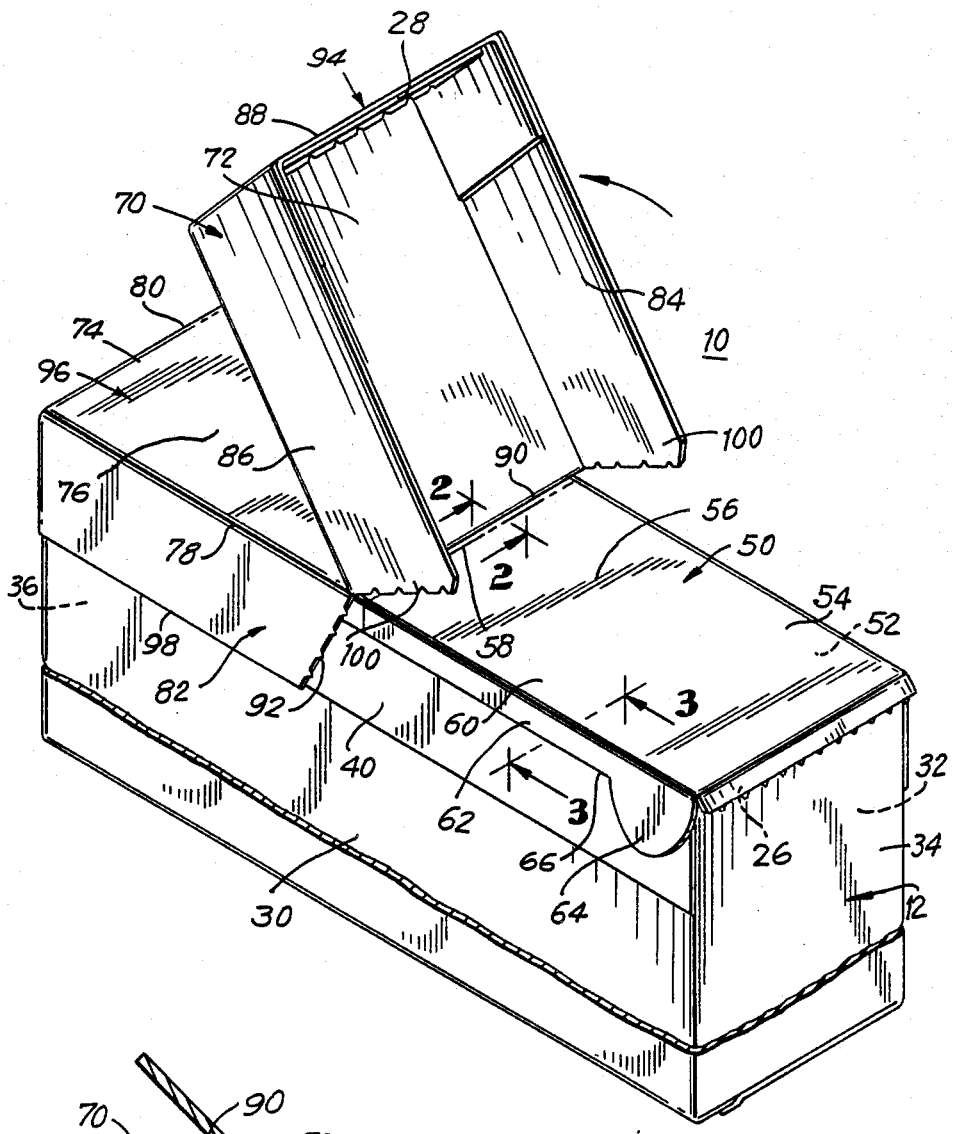
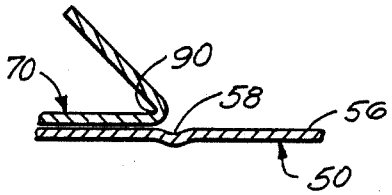
FIG. 2

FIG. 3
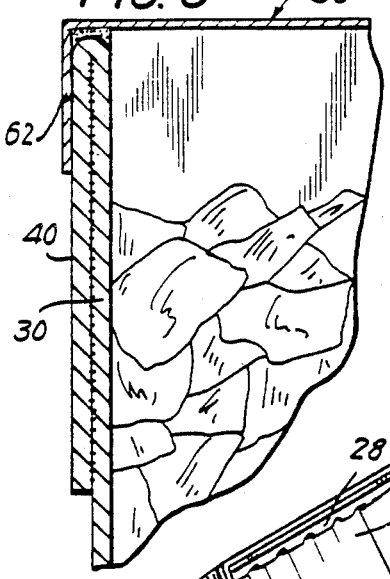
FIG. 8
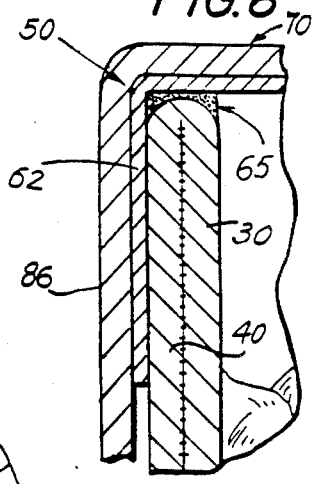
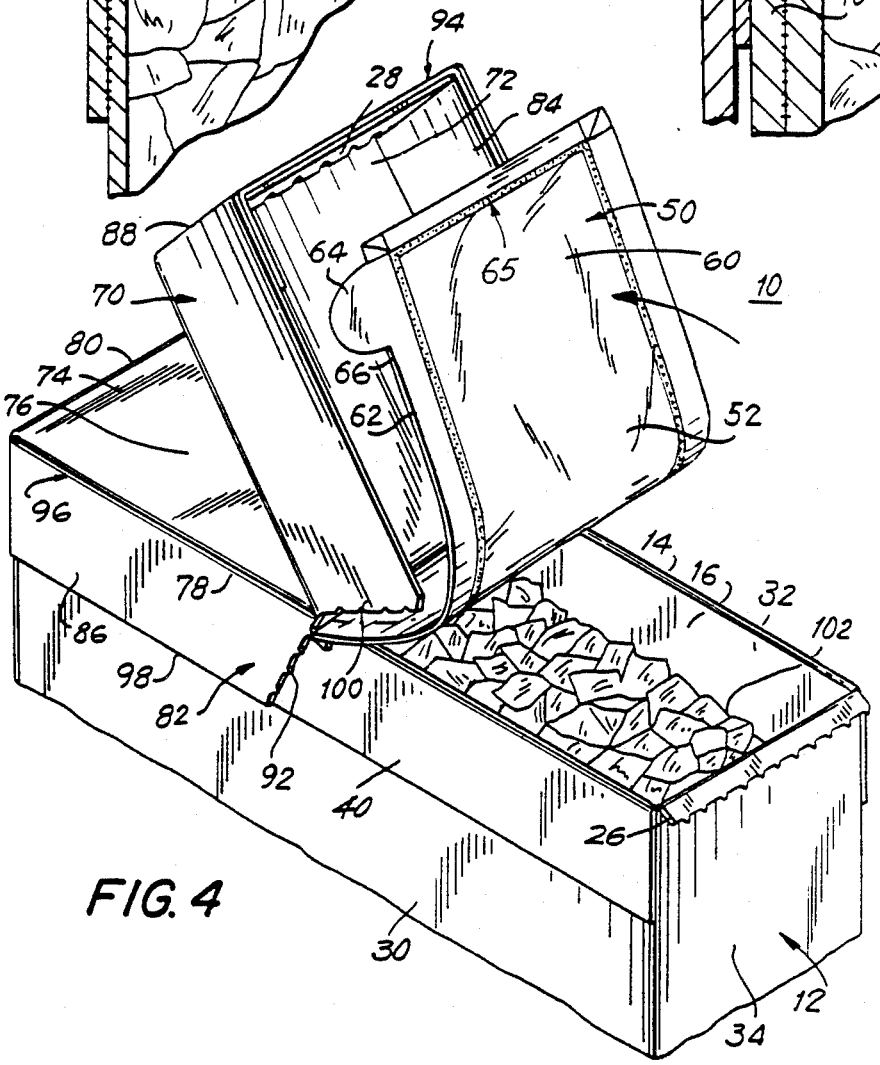
FIG. 4

BARRIER CARTON WITH RECLOSABLE POUR SPOUT

DESCRIPTION

1. Field of Invention

This invention generally relates to moisture barrier carton constructions and, more particularly, a carton including a hermetically sealed membrane liner and reclosable cover which defines a pour spout.

2. Background Art

In packaging granulated or pulverized food products and products having sifting characteristics, it has been customary in the food industry to employ cartons provided with pouch liners formed from moisture impervious papers, foils or plastics. Such pouch liners typically have ends which are fused by heat to form closure ridges or fins. Once opened, the carton is resealed by folding or rolling the open ends of the inner pouch.

In order to effect cost savings in material and production machinery, and extended product shelf life, the packaging industry has developed and marketed linerless cartons provided with thermoplastic moisture-proof coatings and barrier closures. This approach is exemplified by U.S. Pat. Nos. 2,795,364 and 2,886,231, both to B. Benzon-Petersen, which are directed to cartons having rectangular parallelepiped configurations and a closure formed by hingedly attached and overlapping closure flaps. A barrier seal is obtained by attaching a sealing membrane to the flaps when they are oriented in an outward direction prior to their closure. However, this structure does not provide a moisture barrier once the membrane seal is broken limiting the usefulness of the package.

An alternative carton construction is disclosed in U.S. Pat. No. 3,606,133 to G. L. Meyers in which an auxiliary cover blank is secured to and reinforces a carton corner. The auxiliary cover includes a top panel and depending front and side flaps which are attached to a perforated top panel of the carton, and an end flap which extends from and is hingedly attached to the top end of the carton. A top flap extends over the end of the carton and underlies the auxiliary cover. Transverse crease lines in the top panel define a hinged cover which is opened by pivoting the auxiliary blank outward to sever the perforated top panel and a terminal portion of the end flap which is adhesively attached to the auxiliary cover. Once opened, the hinged end flap portion frictionally engages the auxiliary cover to effect reclosure of the carton. This closure arrangement is complex requiring multiple paperboard layers and does not securely close the cover.

Another approach of the prior art, represented by U.S. Pat. No. 4,421,236 to Lowe, employs a hinged cover having a continuous, peripheral depending flange which provides a pour spout. The cover frictionally engages the carton for reclosure. Absent is a positive locking reclosure feature.

The present invention is directed to an improved linerless carton including a sealing membrane and resealing structure of uncomplex design and enhanced effectiveness over prior art pouch and cover closures. The invention advances known moisture barrier closures by incorporating a reclosable pour spout structure which may be maintained in open position for dispensing contents of a carton and securely closed to maintain product freshness. It will be appreciated that linerless cartons provide cost savings in materials and manufacturing efficiencies over pouch arrangements, and that a reclosable moisture barrier carton with an effective dispensing spout will meet a need of the packaging art.

Accordingly, it is the broad object of the present invention to provide an improved moisture barrier carton of economical design which is easily opened and resealed by the consumer.

A more specific object of the invention is to provide a linerless carton incorporating a hinged cover and pour spout which obtains a moisture barrier seal improved over the prior art.

A still further object of the invention is to provide a moisture barrier carton including a pour spout which may be readily locked in open and closed positions.

DISCLOSURE OF THE INVENTION

In the present invention, these purposes, as well as others which will be apparent, are achieved generally by providing an open ended carton including a membrane liner for sealing the carton opening, and a flat top cover which is dimensioned to overlie the membrane. The cover includes a top panel having opposing edges, and a flange which depends from the opposing edges and extends around the periphery of the carton. A transverse score line in the top panel and contiguous perforation lines in the peripheral flange divide the cover into first and second sections to provide a hinged cover and pour spout. Secure reclosure of the cover after severance of the membrane liner is obtained by a closure means including an extension panel which is hingedly attached to a top peripheral side edge of the carton. The extension panel includes first and second extension sections which are defined by a transverse line of perforations extending across its width. The second extension section which forms the terminal end of the extension panel is heat sealed to the peripheral cover flange to fix the cover in locking engagement with the carton opening. Severance of the first extension section by outward pivoting of the first panel section defines an indentation between the top panel and the second extension section which receives the severed first attachment section for locking reclosure of the cover.

In a preferred embodiment of the invention, the carton has a generally parallelepiped configuration and a bottom end closure lined with a sealing membrane. The membrane liner of this embodiment includes a central area dimensioned to overlie the carton opening and a peripheral extension which is heat sealed to exterior surfaces of the carton. To provide a carton barrier seal and facilitate severance of the cover, the membrane extension is heat sealed to surfaces of the first extension section which underlie the cover flange. The cover is locked in open position by orienting the perforations in the flange so that they extend angularly from opposing edges of the top panel to terminal flange edges in the unopened second cover section. In use the angled depending flange of the first extension section are flexed inward and received within the carton opening to lock the cover in open position for dispensing of the carton contents.

Other objects, features and advantages of the present invention will be apparent when the detailed description of the preferred embodiments of the invention are considered in conjunction with the drawings which should be construed in an illustrative and not limiting sense as follows:

BRIEF DESCRIPTION OF THE DRAWINGS

FIG. 1 is a perspective view of a rectangular parallelepiped carton according to the invention including a sealing membrane and reclosable carton cover;

FIG. 2 is a horizonatal cross-sectional view of the cover and underlying membrane liner taken along the line 2—2 of FIG. 1;

FIG. 3 is a horizontal cross-sectional view of the carton taken along the line 3—3 of FIG. 1;

FIG. 4 is a perspective view of the carton showing the manner in which the membrane liner is folded back when opening the carton;

FIG. 8 is a horizontal cross-section of the carton taken along the the line 8—8 of FIG. 7;

BEST MODE OF CARRYING OUT THE INVENTION

Figure 5:
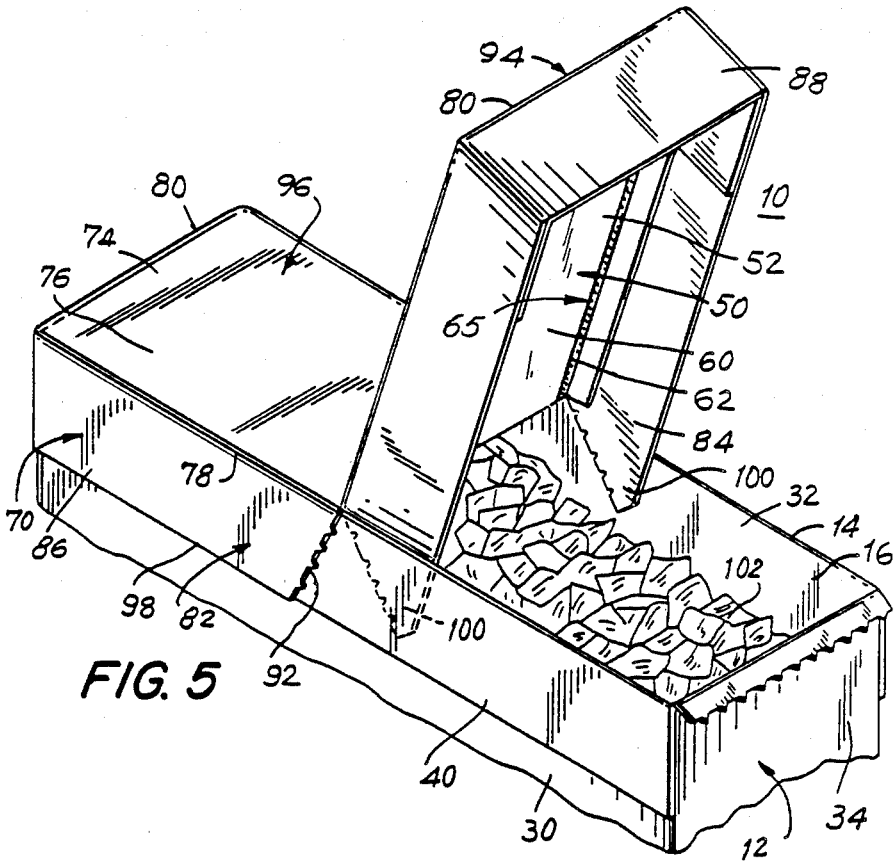
FIGS. 5 and 6 are perspective views of the carton similar to FIG. 4 showing side cover flanges positioned in the carton opening to lock the cover in open orientation for dispensing of the carton contents.

Referring now to the drawings, a carton, generally designated 10, including a membrane liner 50 for sealing a carton opening and a reclosable cover 70 is shown in FIGS. 1–11. The carton 10 and cover are formed from blanks, illustrated in FIGS. 13 and 14, which will be described following a discussion of the carton construction.

The carton 10 is preferably fabricated of a high moisture barrier polymer extrusion coated folding carton paperboard, for example, paperboard having an exterior coating of 10 lb. low density polyethylene and interior coatings of 30 lb. high density and overlying 10 lb. low density polyethylene, such coatings being per 3000 sq. ft. of board. The carton includes a body portion formed by an upright boundary wall 12, a top end peripheral edge 14 which defines a carton opening 16, and an extension panel 18 which is hingedly attached to the peripheral edge. The extension panel includes interior and exterior surfaces 20, 22, and a first transverse line of perforations 24 across its width which define first and second extension sections 26, 28.

In the preferred embodiment, the boundary wall 12 has a generally parallelepiped configuration including front 30, rear 32, first and second side 34, 36, and bottom 38 wall panels. The extension panel 18 is attached to the first side wall 34, see FIGS. 9 and 10. For enhanced structural rigidity in the top end of the carton, the front, rear, and second side wall panels 30, 32, 36 are provided with a continuous flange 40 which is heat sealed to the exterior surface of the carton boundary wall. The continuous flange 40 permits use of paperboard of lesser caliber thickness for cost efficiencies.

A moisture barrier closure of the carton is obtained by employment of the membrane liner 50 which may be fabricated of a moisture-proof coated paper, plastic or foil having specifications conventionally known in the art.

The membrane liner 50 which has a rectangular configuration includes interior and exterior sides 52, 54, a central area 56 which is dimensioned to overlie the carton opening 16, a second transverse perforation line 58 which permits removal of a portion 60 of the membrane for access to the carton, and a peripheral extension 62 which is heat sealed to the exterior surface of the carton at an adhesion area 65. For reasons which will be discussed below, the peripheral extension 62 is heat sealed to the interior surface 27 of the first extension section 26. Tab releases 64 may also be positioned on opposing longitudinal edges 66 of the membrane to facilitate removal of membrane portion 60. See FIGS. 1 and 4.

A preferred membrane liner 50 is fabricated of polyester and has an interior coating of polyethylene film so that the liner may be heat sealed to the carton. The removable liner portion 60 may also be coated with a variety of polymer based dispersions in adhesion area 65, such as ethylene vinyl acetate (EVA), to facilitate severance of the heat seal between the membrane and carton. See FIG. 4.

The cover 70 includes interior and exterior surfaces 72, 74, a top panel 76 dimensioned to overlie the membrane liner 50 which has opposing longitudinal and transverse edges 78, 80, and a flange 82 which depends from the panel edges 78, 80 and extends around the periphery of the carton boundary wall. Flange 82 includes a interior surface 84 and longitudinal and transverse sections 86, 88. A transverse score line 90 in the top panel 76 and contiguous perforations 92 in the longitudinal flange sections 86 define first and second hinged cover sections 94, 96, see FIGS. 1 and 4.

Perforations 92 extend angularly from the transverse score line 90 to terminal flange edges 98 in the second cover section 96. Severance of perforations 92 defines angled longitudinal flange portions 100 in the first cover section 94. These angled flanges provide means for locking the cover in open position in a manner which will be discussed below.

Figure 9:
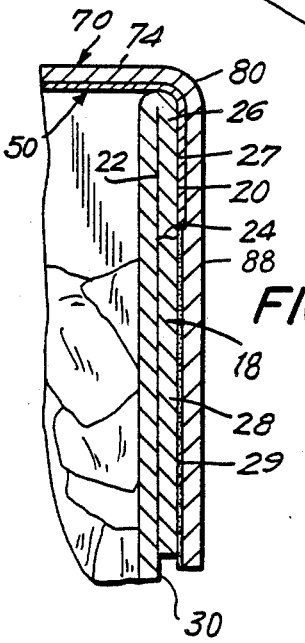
FIG. 9 is a vertical cross-section of the carton taken along the line 9—9 of FIG. 7.

A moisture barrier closure of the carton 10 is provided by affixing peripheral flange 82 of the second cover section 96 to the carton boundary wall 12, and an interior surface 29 of the second extension section 28 to the transverse cover flange 88, as shown in FIG. 9. Conventional heat sealing methods are preferably employed for this purpose.

Attention is now directed to the reclosable pour spout feature of the the invention. As best shown in FIG. 2, transverse score line 90 of the cover overlies the second membrane perforation line 58, so that upon removal or outward pivoting of membrane portion 60 to underlie the cover, a pour spout 102 is defined for dispensing contents of the carton. Outward pivoting of the first cover section 94 about transverse score line 90 severs perforations 24 which connect the first and second extension sections 26, 28, and contiguous flange perforations 92 to define the pour spout.

Figure 6:
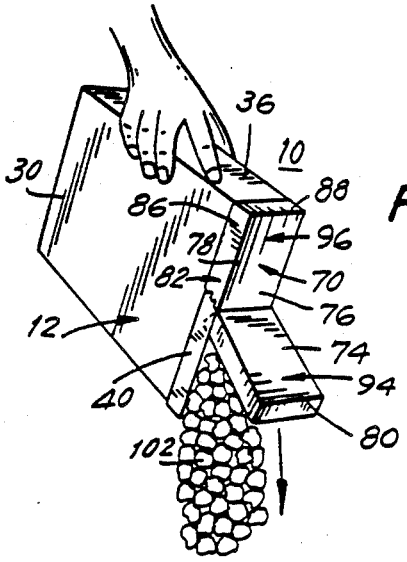
Figure 7:
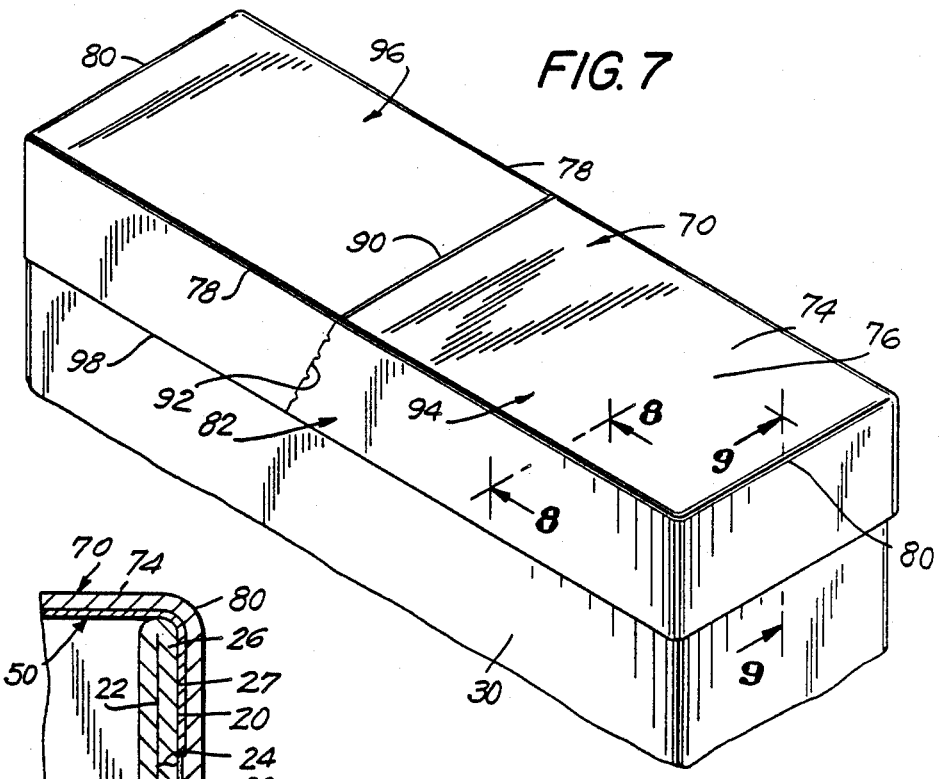
FIG. 7 is a perspective view of the carton showing carton cover prior to opening and severing of closure perforations.

Advantageously, the angled flange portions 100 flex inwardly and are received in the carton opening 16, as shown in FIGS. 5 and 6, to position the cover in open orientation for dispensing of the carton contents.

Figure 10:
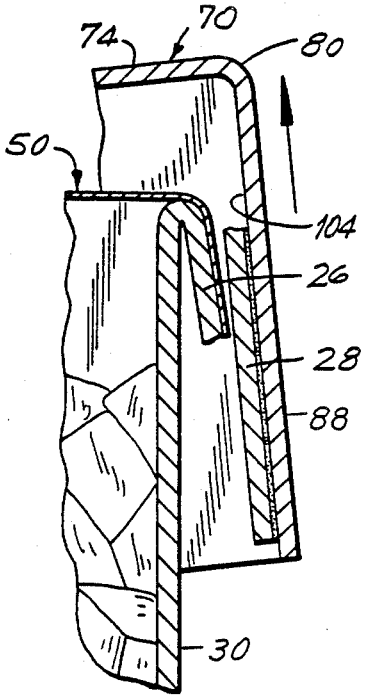
FIG. 10 is a vertical cross-section of the carton, similar to FIG. 9, showing the cover pivoted outwardly.

The reclosure feature of the invention is provided by the arrangement of first and second extension sections 26, 28 which coact to releasably lock the cover 70 in closed position. As shown in FIG. 10, severance of the second extension panel 28 defines an indentation 104 in transverse cover flange 88 by its spaced relation to the interior surface 72 of the top cover panel 76. This indentation 104 receives the first extension section 26 which is hingedly attached to the peripheral edge 14 of the carton in a locking relation. See FIG. 9.

In the preferred embodiment the second extension section 28 is heat sealed to the transverse flange section 88 of the cover; the first extension section 26 is sealed to the peripheral extension 62 of the membrane which underlies but is not affixed to the cover. Provision for severance of the extension sections provides the reclosure structure of the invention. It will be recognized that other conventional techniques may be employed to obtain the release of the first extension section 26. For example, the first extension may be heat sealed to tranverse cover flange 88 but coated with a formulated microcrystalline wax to facilitate severance of the seal.

FIGS. 5 and 6 illustrate the manner in which the cover is oriented in open and locked position for dispensing contents of the carton. It should be noted that the membrane 50 may be received within the cover 70 after release from the carton boundary wall to enhance airtight reclosure of the cover.

Figure 11:
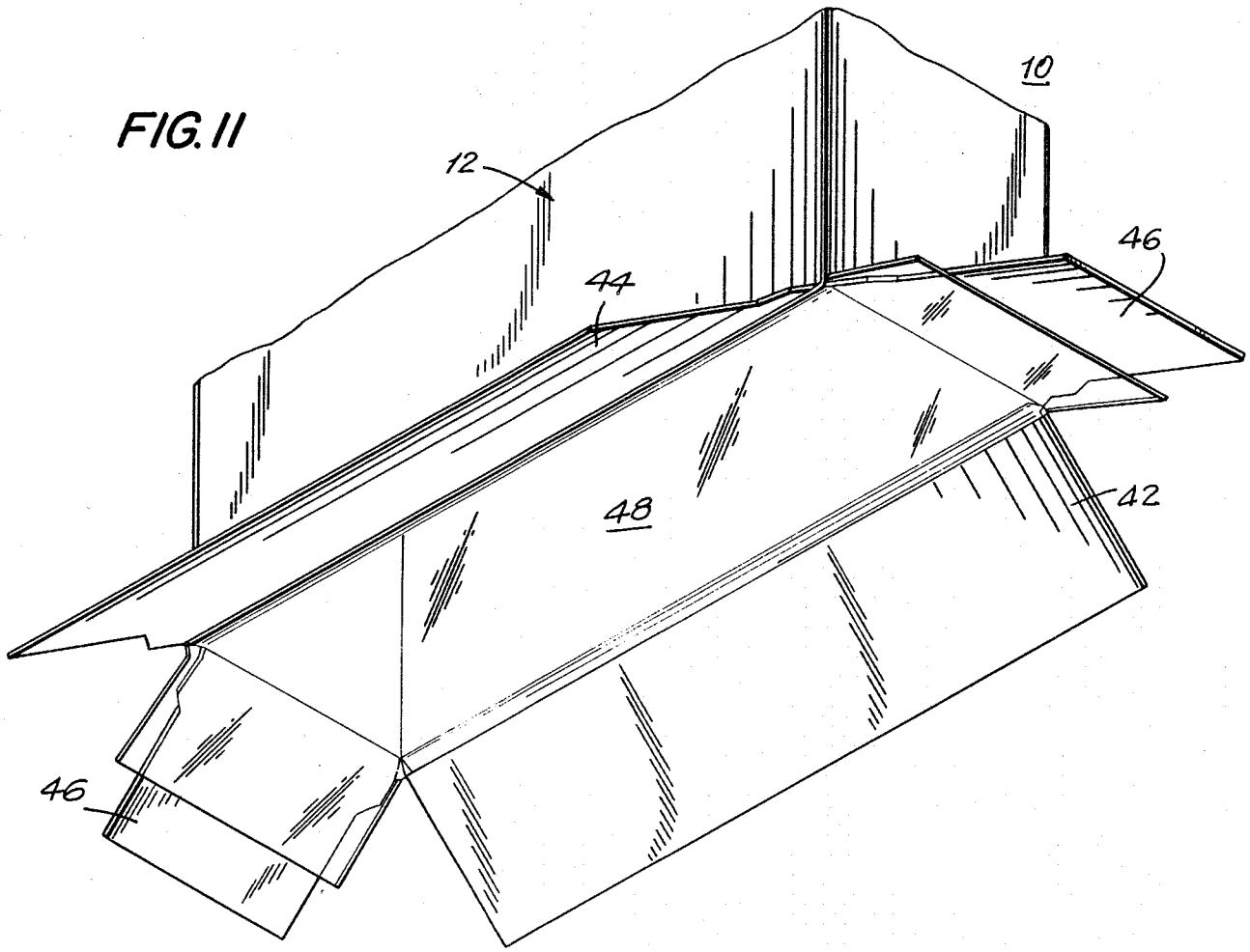
FIG. 11 is a perspective view of the bottom end of the carton showing an arrangement of closure flaps and a sealing membrane.
Figure 12:
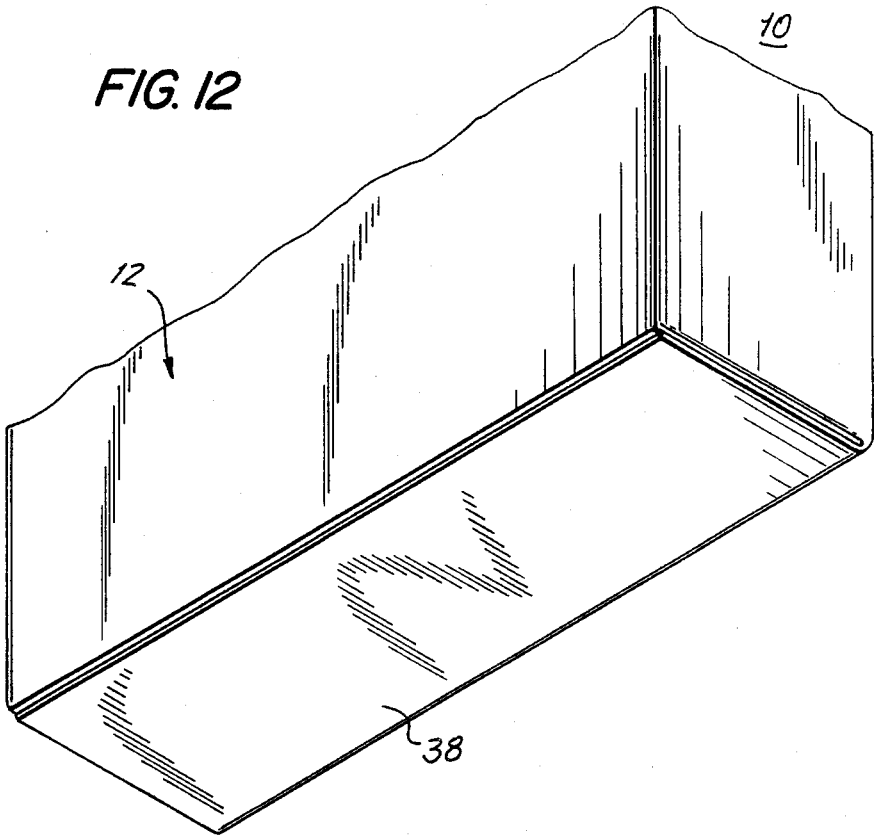
FIG. 12 is a perspective view of a bottom end of the carton showing the closure flaps in sealed relation.

As illustrated in FIGS. 11 and 12, the bottom carton wall 38 is formed from overlapping longitudinal base and transverse side flaps 42, 44, and 46 which are hingedly attached to a bottom peripheral edge 45. A sealing membrane 48 which may be fabricated of polyester is heat sealed to interior surfaces of the closure flaps when they oriented outwardly prior to closure to hermetically seal the bottom end of the carton. Advantageously, the cover 70 with attached membrane liner 50 and the bottom end sealing membrane 48 coact to provide a moisture barrier carton without requirement of conventional pouch arrangements effecting cost savings.

Figure 14:
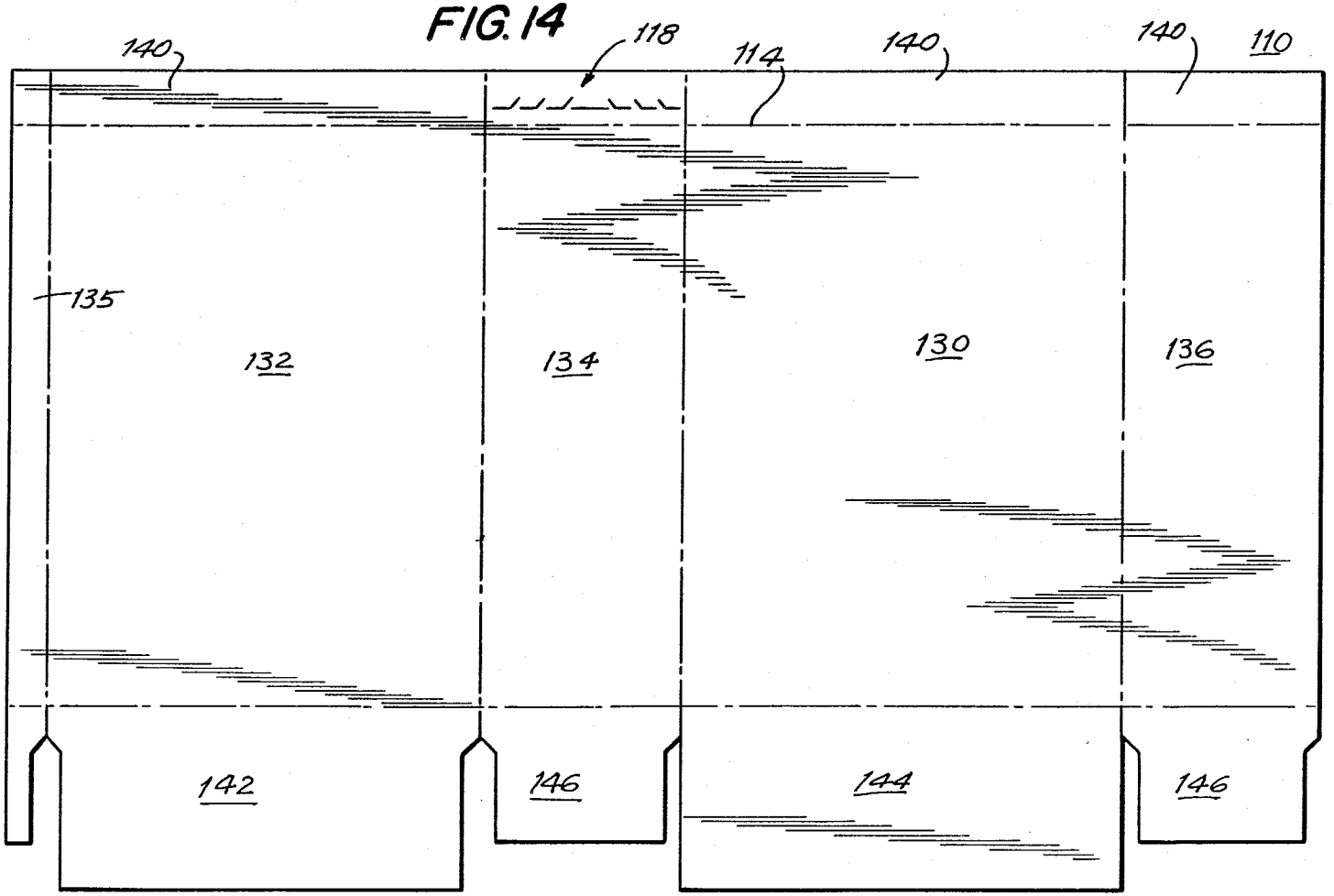

A blank for forming the carton of the invention, generally designated 110, is illustrated in FIG. 14. Attention is directed to the arrangement of continuous flange sections 140 and extension panel 118 which are hingedly attached to carton body walls 130–136 at a top end peripheral edge 114. The bottom end closure is formed by overlapping longitudinal base and transverse side flaps 142, 144, and 146 which are attached to the carton body walls at a bottom end peripheral edge 145.

Figure 13:
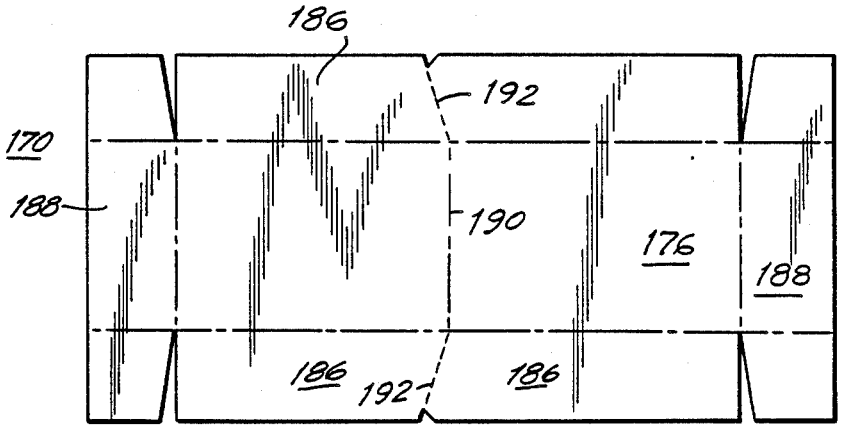
FIGS. 13 and 14 are plan views of blanks cut and scored to form the cover and carton illustrated in the drawings.

A separate blank for forming the cover 70 is illustrated in FIG. 13. The cover blank 170 includes a central top panel 176, peripheral flange 182 including longitudinal and transverse sections 186, 188, transverse score line 190, and contiguous perforation lines 192.

From the foregoing, it will be appreciated that the present invention provides a moisture barrier reclosable carton 10 which achieves the objects stated heretofore. In particular, a carton 10 is provided which includes a moisture impervious membrane liner 50 which coacts with a cover 70 to obtain a reclosable moisture barrier seal. The cover 70 includes a hinged first section 94 which pivots outwardly to sever perforations 24 in extension panel 18 and contiguous perforations 92 in the peripheral cover flange 82 to define a pour spout. The cover includes angled flange portions 100 which flex inwardly and are received in the carton opening 16 to lock the cover 70 in open position for dispensing of the carton contents. A high integrity moisture barrier reclosure is assured by coaction of extension sections 26, 28 which are respectively attached to the carton and cover, and engage in locking relation.

Numerous modifications are possible in light of the above disclosure. For example, the drawings show a carton having a generally parallelepiped configuration. It will be appreciated that other carton configurations are within the scope of the disclosure. Similarly, in the preferred embodiment a membrane 50 is employed to provide a hermetic carton seal, the cover may also be sealed to the carton without a membrane.

Therefore, although the invention has been described with reference to certain preferred embodiments, it will be appreciated that other carton constructions may be devised, which are nevertheless within the scope and spirit of the invention as defined by the claims appended hereto.

We claim:

1. A carton which comprises: an open ended body portion formed by an upright boundary wall, and a top end peripheral edge which defines the carton opening, said body portion including a side wall and an exterior surface; a membrane liner which is hermetically sealed to the carton opening, said membrane liner including interior and exterior sides, a central area dimensioned to overlie the carton opening and a peripheral extension which is sealed to said exterior surface of the body portion; a cover including a top panel dimensioned to overlie said membrane liner, said top panel including opposing edges, a flange depending from said opposing edges and extending around the periphery of the carton boundary wall, said peripheral flange including a transverse section which overlies said side wall, said cover also including first and second sections defined by a transverse score line in the top panel and contiguous perforation lines in the flange which extend from said opposing edges to a terminal flange edge; and integral closure means for locking said cover in fixed engagement with said carton prior to severance of the hermetic membrane seal, and thereafter providing a locking reclosure feature, said integral closure means including an extension panel hingedly attached to and extending from the top end peripheral edge of the carton, said extension panel including interior and exterior surfaces, and a first transverse line of perforations extending across its width to define first and second extension sections, said interior surface of the first extension section being sealed to the interior surface of the peripheral membrane extension, said interior surface of the second extension section being sealed to said transverse section of the peripheral flange to fix said cover in locking engagement with the carton opening, so that a reclosable pour spout is formed by pivoting said first cover section outwardly about said transverse score line to sever said first perforation line and release said first and second extension sections from engagement, said second extension section thereafter defining an indentation for receiving said first extension section in releasable locking engagement.

2. A carton according to claim 1, wherein said carton body portion is fabricated of a high moisture barrier polymer coated folding carton paperboard.

3. A carton according to claim 2, wherein the body portion has a generally parallelepiped configuration, and the cover has a rectangular configuration.

4. A carton according to claim 3, wherein the carton body portion includes a bottom end closure having interior surfaces, and a second sealing membrane attached to said interior surfaces.

5. A carton according to claim 1, wherein said membrane liner includes a second transverse perforation line disposed in general alignment with said transverse score line to facilitate removal of the membrane in the area of the pour spout.

6. A carton according to claim 1, wherein the perforation lines of said peripheral flange extend angularly from said opposing edges to said terminal flange edge in said second cover section, so that when said first cover section is pivoted outwardly said depending flange of the first cover section may be received within the carton opening for maintaining the cover in open orientation for dispensing of the carton contents.

7. A carton which comprises: an open ended body portion formed by an upright boundary wall, and a top end peripheral edge which defines the carton opening, said body portion including a side wall and an exterior surface; a membrane liner which is hermetically sealed to the carton opening, said membrane liner including a central area dimensioned to overlie the carton opening and a peripheral extension which is sealed to said exterior surface of the body portion; a cover including a top panel dimensioned to overlie said membrane liner, said top panel including opposing edges, a flange depending from said opposing edges and extending around the periphery of the carton boundary wall, said peripheral flange including a transverse section which overlies said side wall, said cover also including first and second sections defined by a transverse score line in the top panel and contiguous perforation lines in the flange which extend from said opposing edges to a terminal flange edge; and integral closure means for locking said cover in fixed engagement with said carton prior to severance of the hermetic membrane seal, and thereafter providing a locking reclosure feature, said integral closure means including an extension panel hingedly attached to and extending from the top end peripheral edge of the carton, said extension panel including interior and exterior surfaces, and a first transverse line of perforations extending across its width to define first and second extension sections, said interior surface of the second extension section being sealed to said transverse section of the peripheral flange to fix said cover in locking engagement with the carton opening, so that a reclosable pour spout is formed by pivoting said first cover section outwardly about said transverse score line to sever said first perforation line and release said first and second extension sections from engagement, said second extension section thereater defining an indentation for receiving said first extension section in releasable locking engagement, said membrane liner including a second transverse perforation line disposed in general alignment with said transverse score line to facilitate removal of the membrane in the area of the pour spout.

8. A carton according to claim 7, wherein said membrane liner includes a tab release for severance of the membrane seal.

9. A carton having a parallelepiped configuration which comprises: an open ended body portion including an exterior surface and front, rear and side walls, and a top end peripheral edge which defines the carton opening; a membrane liner which is hermetically sealed to the carton opening, said membrane liner including interior and exterior sides, a central area dimensioned to overlie the carton opening and a peripheral extension which is heat sealed to said exterior surface of the body portion; a cover including a top panel dimensioned to overlie said membrane liner, said top panel including longitudinal and transverse edges, a flange including longitudinal and transverse sections which respectively depend from said longitudinal and transverse edges and extend around the periphery of the carton boundary wall, said cover also including first and second sections defined by a transverse score line in the top panel and contiguous perforation lines in the flange which extend from said longitudinal edges to terminal flange edges; and integral closure means for locking said cover in fixed engagement with said carton prior to severance of the hermetic membrane seal, and thereafter providing a locking reclosure feature, said closure means including an extension panel hingedly attached to said side wall at the top end peripheral edge of the carton, said extension panel including interior and exterior surfaces, and a first transverse line of perforations extending across its width to define first and second extension sections, said interior surface of the first extension section being heat sealed to the interior surface of said peripheral membrane extension, said interior surface of the second extension section being heat sealed to said transverse section of the peripheral flange in spaced relation to said top panel to fix said cover in locking engagement with the carton opening, so that a reclosable pour spout is formed by pivoting said first cover section outwardly about said transverse score line to sever said first perforation line and release said first and second extension sections from engagement, said second extension section thereafter defining an indentation for receiving said first extension for locking reclosure of the carton.

10. A carton according to claim 9, wherein the contiguous perforation lines of said peripheral flange extend angularly from said longitudinal edges to said terminal flange edge in said second cover section, so that when said first cover section is pivoted outwardly said depending flange of said first cover section may be received within the carton opening for maintaining the first cover section in open orientation for dispensing of the carton contents.

11. A carton having a parallelepiped configuration which comprises: an open ended body portion including front, rear and side walls, and a top end peripheral edge which defines the carton opening; a membrane liner which is hermetically sealed to the carton opening; a cover including a top panel dimensioned to overlie said membrane liner, said top panel including longitudinal and transverse edges, a flange including longitudinal and transverse sections which respectively depend from said longitudinal and transverse edges and extend around the periphery of the carton boundary wall, said cover including first and second sections defined by a transverse score line in the top panel and contiguous perforation lines in the flange which extend from said longitudinal edges to terminal flange edges; and integral closure means for locking said cover in fixed engagement with said carton prior to severance of the hermetic membrane seal, and thereafter providing a locking reclosure feature, said closure means including an extension panel hingedly attached to said side wall at the top end peripheral edge of the carton, said extension panel including interior and exterior surfaces, and a first transverse line of perforations extending across its width to define first and second extension sections, said interior surface of the second extension section being heat sealed to said transverse section of the peripheral flange in spaced relation to said top panel to fix said cover in locking engagement with the carton opening, so that a reclosable pour spout is formed by pivoting said first cover section outwardly about said transverse score line to sever said first perforation line and release said first and second extension sections from engagement, said second extension section thereafter defining an indentation for receiving the first extension section for locking reclosure of the carton, said membrane liner including a second transverse perforation line disposed in general alignment with said transverse perforation line to facilitate removal of the membrane in the area of the pour spout.

12. A carton according to claim 11, wherein said membrane liner includes a tab release for severance of the membrane seal.

* * * * *